United States Patent [19]

Suzuki et al.

[11] Patent Number: 4,697,559

[45] Date of Patent: Oct. 6, 1987

[54] METHOD OF CONTROLLING AN AIR-FUEL RATIO FOR AN INTERNAL COMBUSTION ENGINE

[75] Inventors: Fujiyuki Suzuki; Akira Osada, both of Hamamatsu, Japan

[73] Assignee: Suzuki Jodosha Kogyo Kabushiki Kaisha, Shizuoka, Japan

[21] Appl. No.: 786,910

[22] Filed: Oct. 11, 1985

[30] Foreign Application Priority Data

Nov. 30, 1984 [JP] Japan ..... 59-253095

[51] Int. Cl.[4] ..... F02M 3/045

[52] U.S. Cl. ..... 123/325; 123/489

[58] Field of Search ..... 123/325, 326, 440, 489, 123/493

[56] References Cited

U.S. PATENT DOCUMENTS 4,186,691 2/1980 Takase et al. ..... 123/325

FOREIGN PATENT DOCUMENTS 0076229 7/1978 Japan ..... 123/325

0035138 2/1982 Japan .

0073840 5/1982 Japan .

0035246 3/1983 Japan .

0032644 2/1984 Japan .

0046336 3/1984 Japan ..... 123/326

0155549 9/1984 Japan ..... 123/325

*Primary Examiner*—Willis R. Wolfe, Jr.

*Attorney, Agent, or Firm*—Flynn, Thiel, Boutell & Tanis

[57] ABSTRACT

In a method of controlling an air-fuel ratio for an internal combustion engine, a control section feedback-controls an electronically controlled carburetor in response to a signal from an $O_2$ sensor which detects the concentration of $O_2$ in the exhaust gas. When the $O_2$ sensor outputs a rich signal for a predetermined time period after the air-fuel ratio is leaned upon deceleration of the engine, the rich air-fuel ratio is instantaneously and forcibly leaned by the control section in order to rapidly return it to a proper value. Thereafter, ordinary feedback control is resumed. With this method, the quantity of harmful exhaust gas components such as CO or the like can be reduced without making the operational performance of the engine deteriorate.

4 Claims, 8 Drawing Figures

METHOD OF CONTROLLING AN AIR-FUEL RATIO FOR AN INTERNAL COMBUSTION ENGINE

FIELD OF THE INVENTION

The present invention relates to a method of controlling an air-fuel ratio for an internal combustion engine and, more particularly, to a method of controlling an air-fuel ratio for an internal combustion engine which cleans the exhaust gas after a control operation for leaning the air-fuel ratio upon deceleration was performed.

BACKGROUND OF THE INVENTION

In an internal combustion engine for a motor vehicle, variations in load and running speed of the vehicle, namely the rotating speed of the engine, are extremely large. In various kinds of operating states, in combination with both of these variations, performance characteristics such as a low fuel consumption, minimal harmful exhaust components and the like are demanded. Therefore, it is necessary to optimize the air-fuel ratio in various operating states.

As a method of controlling so as to optimize an air-fuel ratio, there is a method wherein the air-fuel ratio is controlled on the basis of a detection signal from a sensor which measures the concentration of a particular gas in the exhaust gas, for example an $O_2$ sensor which detects the concentration of oxygen in the exhaust gas, the method including the step of feedback-controlling the air-fuel ratio such that the best combustion state is always derived for the various kinds of operating states.

In conventional methods of controlling an air-fuel ratio of an internal combustion engine, a signal from an exhaust sensor, for instance from an $O_2$ sensor, is used as an input to an engine control unit (ECU) and a valve provided in a carburetor is feedback-controlled by a control signal from the ECU, thereby controlling the air-fuel ratio. In particular, upon deceleration, deceleration feedback-control is performed to prevent overheating of a catalyst in a catalytic converter due to unburnt HC or to improve the fuel consumption efficiency.

On the other hand, there is a case where a rich signal is again output by the $O_2$ sensor after the deceleration feedback control. In such a case, the air-fuel ratio is corrected by way of a conventional feedback control.

However, there is a drawback in that, as indicated by alternate long and short dash lines in FIG. 4*e*, execution of the conventional feedback control causes the amount of CO in the exhaust to be increased because the air-fuel ratio is enriched, so that the cleaning of the exhaust gas cannot be attained.

SUMMARY OF THE INVENTION

It is an object of the present invention to provide a method of controlling an air-fuel ratio for an internal combustion engine in which a rich air-fuel ratio is forcibly corrected so as to become lean in order to rapidly return the righ air-fuel ratio to a proper value, thereby making it possible to reduce the quantity of harmful exhaust gas such as CO or the like without making the operation performance deteriorate.

This object is accomplished by a method of controlling an air-fuel ratio of an internal combustion engine which feedback-controls an electronically controlled carburetor using a control section which receives a signal from an exhaust sensor, including the steps of:

instantaneously and forcibly correcting a rich air-fuel ratio with the control section so that it becomes lean in order to rapidly return the rich air-fuel ratio to a proper value when the exhaust sensor outputs a rich signal for a predetermined time period after the air-fuel ratio was leaned upon deceleration of the engine; and thereafter continuing an ordinary control.

According to the present invention, when an $O_2$ sensor outputs a rich signal for a predetermined time interval after the air-fuel ratio is leaned upon deceleration of the engine, the control section forcibly leans the rich air-fuel ratio to a proper value, thereby preventing the air-fuel ratio from becoming unnecessarily rich and thus reducing the quantity of exhaust gas such as CO or the like without making the operation performance deteriorate.

The present invention will be apparent from the following detailed description, taken in conjunction with the accompanying drawings.

BRIEF DESCRIPTION OF THE DRAWINGS

An embodiment of the present invention will now be described in detail hereinbelow with reference to the drawings. In the drawings.

DETAILED DESCRIPTION

Figure 1:
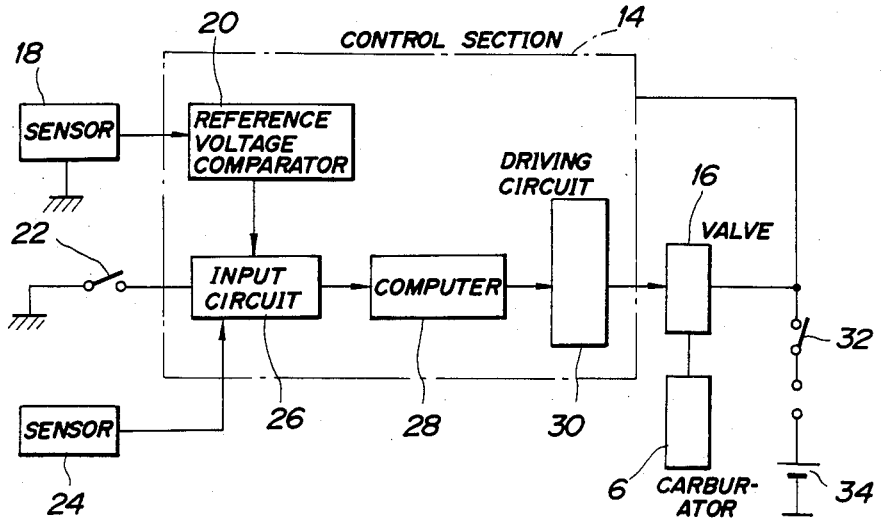
FIG. 1 is a block diagram of an apparatus for controlling an air-fuel ratio according to the invention.
Figure 2:
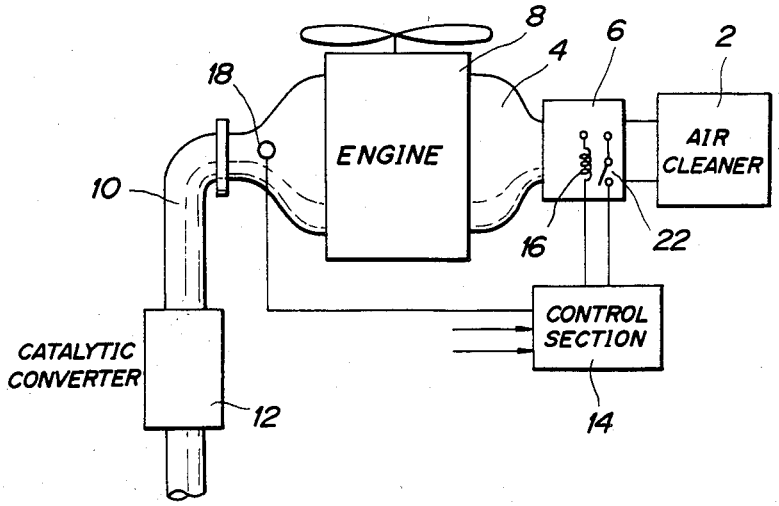
FIG. 2 is a diagramatic view of an internal combustion engine.

FIGS. 1 to 4 show an embodiment of the invention. In FIGS. 1 and 2, an air cleaner 2 and an intake pipe 4 are provided. An electronically controlled Venturi carburetor 6 is arranged in the intake pipe 4 downstream of the air cleaner 2. One side of the carburetor 6 communicates through pipe 4 with a combustion chamber (not shown) in an engine 8. One end of an exhaust pipe 10 communicates with the combustion chamber. A catalytic converter 12 which contains a ternary catalyst performs the catalytic process after combustion and is provided in the exhaust pipe 10.

The carburetor 6 is provided with a valve 16 which is opened and closed by a control section 14 in a manner described later.

To detect the operating state of the engine, an exhaust sensor 18 to detect the concentration of a component of the exhaust gas is attached to the exhaust pipe 10. In this embodiment, for example, an $O_2$ sensor 18 which detects the concentration of $O_2$ in the exhaust gas is attached.

A detection signal from $O_2$ sensor 18 is supplied to the control section 14. If a signal from the $O_2$ sensor 18 indicating a rich $O_2$ concentration continues for a predetermined time period ($T_1$ seconds) after the air-fuel ratio is leaned upon deceleration of the engine, for instance after a fuel-cut operation is performed, the control section 14 controls the rich air-fuel ratio so that this ratio is skipped step-like by only a predetermined amount so that it is leaned as shown in, for example, FIG. 4*d*. Thereafter, the control section 14 performs the feedback control to thereby rapidly return the air-fuel ratio to the proper value.

More specifically, referring to the leftmost portions of FIGS. 4*c* and 4*d*, the control section 14 carries out normal feedback control by slowly increasing the richness of the air-fuel ratio when the detector 18 indicates that the exhaust gases have a low concentration of $O_2$, and slowly leans the air-fuel ratio when the detector indicates that the exhaust gases have a high concentration of $O_2$. As shown in FIG. 4*d*, the changes in the air-fuel ratio occur at a slow rate which corresponds to the slope or gradient $P_1$.

Following a deceleration (FIG. 4*a*), if the detector 18 detects a rich concentration of $O_2$ in the exhaust gases for a period of more than $T_1$ seconds (FIG. 4*c*), the standard feedback control scheme would slowly lean the air-fuel ratio at the rate or slope $P_1$, as shown in broken lines at 40 in FIG. 4*d*. According to the inventive method, however, at the end of the interval $T_1$ the control section 14 leans the air-fuel ratio to a predetermined constant value in a step-like and almost instantaneous manner, as shown at 41 in FIG. 4*d*, after which the standard feedback control scheme is resumed, as shown at 42 in FIG. 4*d*. As shown in FIG. 4*e*, the inventive method causes the concentration of CO in the exhaust to peak at 44, whereas use of the standard feedback control scheme at 40 would cause the concentration of CO to peak at a much higher value 45. The inventive method thus results in a significant reduction in the quantity of CO issued in the exhaust gases, as evident from a comparison of the solid and broken lines in FIG. 4*e*.

As shown in FIG. 1, the control section 14 has a reference voltage comparator 20 which receives a detection signal from the $O_2$ sensor 18, and an input circuit 26 which receives respective output signals from an idle switch 22, from a sensor 24 which detects the rotating speed of the engine, and from the comparator 20. The control section 14 further has a computer 28 which receives an output signal from the input circuit 26 and performs various kinds of arithmetic operations for control, and a driving circuit 30 which receives an output signal from the computer 28.

The comparator 20 compares the analog output of the sensor 18 to a predetermined reference voltage, and produces a digital signal which is respectively high and low when the output of the sensor 18 is respectively above and below the reference voltage.

Reference numeral 32 denotes an ignition switch, and 34 is a battery.

Figure 3:
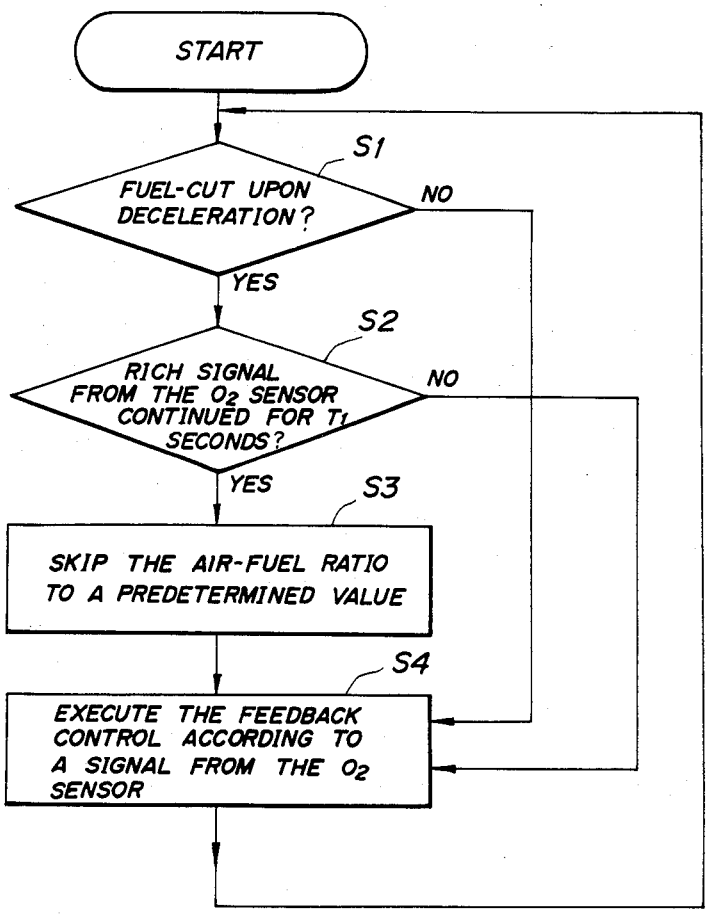
FIG. 3 is a flowchart illustrating the control of an air-fuel ratio according to the invention.
Figure 4:
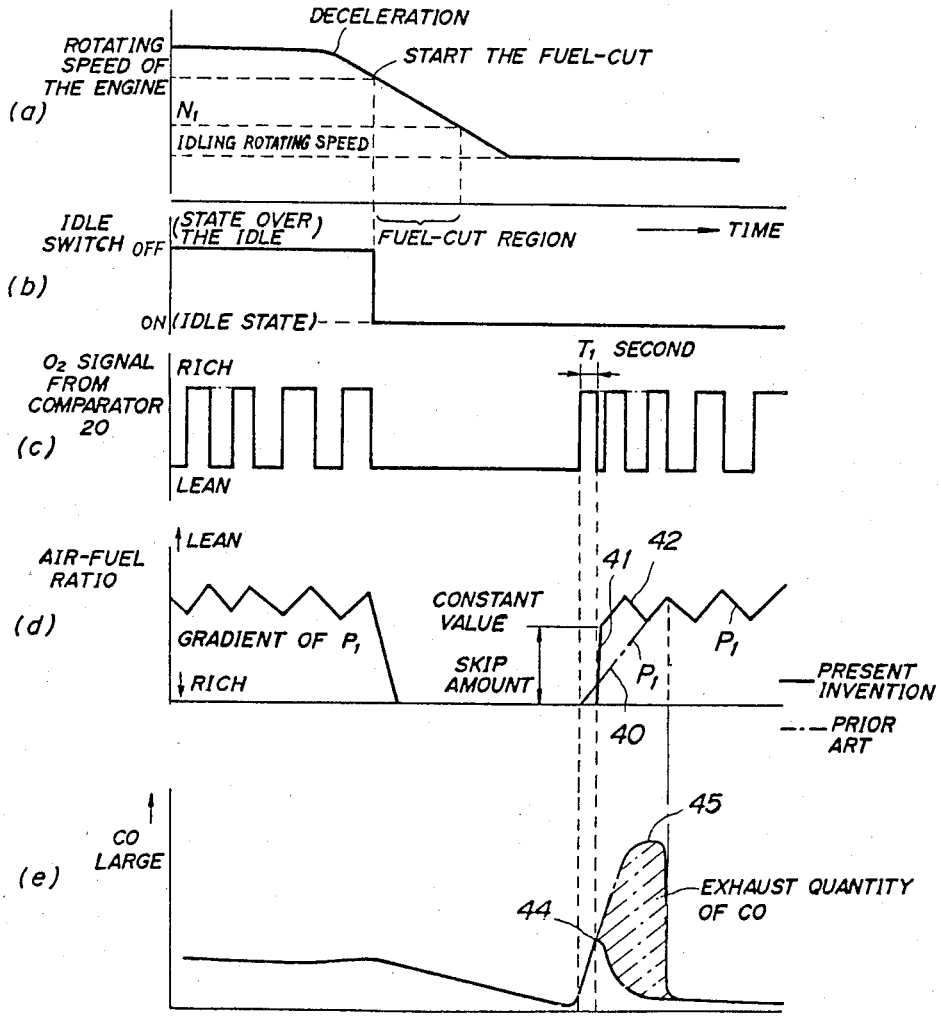
FIGS. 4*a* to 4*e* are respective interrelated graphs which show operating states of various parameters during operation of the engine.

The method of controlling an air-fuel ratio according to the invention will now be explained with reference to the flowchart of FIG. 3.

First, the internal combustion engine is started. In step S1, a check is made to see if a fuel-cut control operation upon deceleration from the start of the engine is performed or not. If the answer is NO in step S1, control transfers to step S4, where feedback control of the air-fuel ratio is executed in accordance with a detection signal from the $O_2$ sensor 18. If the answer is YES in step S1, control transfers to step S2 and a check is made to see if the rich signal of the $O_2$ sensor 18 continues for $T_1$ seconds or not. If the answer is NO in step S2, the processing routine advances to step S4 and feedback control of the air-fuel ratio according to the output signal of the $O_2$ sensor 18 is performed in the same manner as above. If the answer is YES in step S2, as shown in FIG. 4*d*, control is transferred to step S3 and the duty is skipped by only a predetermined amount such that the air-fuel ratio is leaned, thereby correcting the air-fuel ratio to a constant value. Thereafter, in a similar manner as mentioned above, feedback control is executed.

Due to this, the air-fuel ratio can be corrected by the control section such that it is returned to the appropriate value without making the operational performance of the engine deteriorate. An increase in the quantity of CO in the exhaust, which is caused by making the air-fuel ratio rich, can thus be prevented, and the quantity of harmful exhaust gas can be reduced.

The foregoing control of the air-fuel ratio can be easily realized by merely changing a program in the control section, so that the cost can be reduced and this method is practically advantageous.

Further, the occurrence of engine stall can be prevented by skipping the air-fuel ratio so that it is leaned after detection of the rich signal from the $O_2$ sensor.

In addition, the fuel-cut region can be expanded to include both the case where the engine is decelerated and the case where the air-fuel ratio is rich after deceleration, so that the fuel consumption can be saved.

The present invention is not limited to the foregoing embodiment, because many modifications and variations are possible within the spirit and scope of the appended claims of the invention.

For example, in the preferred embodiment of the invention, the correcting operation after the fuel-cut control has been described as the correcting operation after the air-fuel ratio was leaned. However, it is sufficient that this operation is performed after the air-fuel ratio was leaned. For instance, after the air-fuel ratio was leaned by supplying air, the air-fuel ratio can be also corrected so as to become lean. By this method as well, the fuel consumption can be saved in a manner similar to the foregoing embodiment.

As described above, according to the present invention the air-fuel ratio, which is enriched as a result of the rich signal from the exhaust sensor occurring for a predetermined time period after the air-fuel ratio was leaned upon deceleration of the internal combustion engine, is forcibly corrected by the control section so that it becomes lean in order to rapidly return the rich air-fuel ratio to the proper value. Therefore, the quantity of harmful exhaust gas such as CO or the like can be reduced without making the operational performance of the engine deteriorate. The control of the air-fuel ratio can be performed by merely changing a program in the control section, so that the cost can be reduced. Further, by controlling an air-fuel ratio after detection of a rich signal from the exhaust sensor, the occurrence of engine stall can be prevented. Moreover, the fuel-cut region can be expanded and the fuel consumption can be reduced.

The embodiments of the invention in which an exclusive property or privilege is claimed are defined as follows:

1. In a method of controlling an air-fuel ratio for an internal combustion engine, including the step of feedback-controlling an electronically controlled carburetor using a control section which receives a signal from an exhaust sensor, the improvement comprising the steps of:

instantaneously and forcibly causing said control section to correct a rich air-fuel ratio so that said ratio becomes lean in order to rapidly return the air-fuel ratio to a proper value when said exhaust sensor outputs a rich signal for a predetermined time period after the air-fuel ratio is increased in richness upon deceleration of the internal combustion engine; and thereafter resuming said step of feedback-controlling said carburetor.

2. The method of controlling an air-fuel ratio according to claim 1, wherein said exhaust sensor is an $O_2$ sensor which detects the concentration of $O_2$ in the exhaust gas.

3. In a method of controlling an air-fuel ratio in an internal combustion engine having an intake passage, an exhaust passage, and an exhaust sensor in said exhaust passage, including the step of monitoring with said exhaust sensor the concentration of a predetermined component of exhaust gases passing through said exhaust passage, the step of effecting feedback control of an air-fuel ratio within said intake passage in response to the concentration of said predetermined exhaust gas component in said exhaust passage, and the steps of interrupting said feedback control and causing said air fuel ratio to be increased in richness in response to deceleration of said engine, the improvement comprising the steps of: causing said air-fuel ratio to be substantially instantaneously reduced in richness by a predetermined value in response to detection with said exhaust sensor, when said air-fuel ratio has been increased in richness due to deceleration of said engine, of the concentration of said predetermined exhaust gas component being continuously in excess of a predetermined value for a predetermined period of time; and resuming feedback control of said air-fuel ratio following said substantially instantaneous reduction in richness of said air-fuel ratio.

4. The method according to claim 3, wherein said predetermined exhaust gas component is $O_2$, and wherein said exhaust sensor is an $O_2$ sensor which detects the concentration of $O_2$ in the exhaust gases.

* * * * *